United States Patent [19]

Knowles, Jr.

[11] 4,183,098

[45] Jan. 15, 1980

[54] WRIST SUPPORT APPARATUS

[76] Inventor: Miles V. Knowles, Jr., R.R. #1, Roanoke, Ind. 46783

[21] Appl. No.: 907,145

[22] Filed: May 17, 1978

[51] Int. Cl.[2] ..... A63B 71/14

[52] U.S. Cl. ..... 2/16; 2/161 A; 2/162; 128/87 R; 273/54 B; 273/189 A

[58] Field of Search ..... 2/162, 16, 20, 161 A, 2/170, 19; 273/54 B, 189 A; 128/87 R

[56] References Cited

U.S. PATENT DOCUMENTS

| | | | |
|---|---|---|---|
| 3,779,550 | 12/1973 | Benoun et al. | 273/54 B |
| 3,970,305 | 7/1976 | Hawkins | 273/54 B |
| 4,047,250 | 9/1977 | Norman | 2/16 X |
| 4,088,318 | 5/1978 | Massman | 273/54 B |

*Primary Examiner*—Louis Rimrodt
*Attorney, Agent, or Firm*—Richard T. Seeger

[57] ABSTRACT

A first rigid elongated plate has first and second ends, a first end being hingedly attached to a first end of a rigid link to swing freely towards and away from one side of the link within a predetermined included first arc. A second rigid elongated plate, having first and second ends, is hingedly attached to the other end of the link to swing freely towards and away from the one link side within a predetermined included second arc. A flexible envelope encloses the first and second plates and the link to retain the plates and link in end to end hinged relation. Strap members transversely extend from the envelope and are wrappable around the user's hand, wrist, and forearm to hold the envelope, plates, and link in supporting relation thereto. Each hinge attachment comprises a pair of longitudinally extending, normally offset, transversely spaced legs extending from one of the abutting hinged ends and the other of the abutting hinged ends has a longitudinally extending tongue slidable between the transversely spaced legs. The legs and tongue slidably engage the surfaces of the adjoining link and plate thus limiting the hinged movement between the adjoining link and plate beyond that point where the legs and tongue contact the respective surfaces of the adjoining member.

6 Claims, 6 Drawing Figures

WRIST SUPPORT APPARATUS

BACKGROUND OF THE INVENTION

1. Field of the Invention

This invention is in the field of articulated supports for limiting wrist movement in a backward flexing direction and providing flexing of the wrist wherein the palm of the hand is movable toward the forearm, and more particularly to such supports for use in sporting activities such as bowling.

2. Description of the Prior Art

Over the years, numerous devices have been devised to support the hand, wrist, and forearm, both for orthopedic purposes and as aids for engaging in sporting activities, and in particular bowling. The object of these devices is to support the limbs in a manner to correct, limit, and direct articulated movement in a particular desired manner. These devices, especially in areas such as bowling, have found increasing use and acceptance and are exemplified by the disclosures in the following U.S. Pat. Nos.: 3,512,776; 3,606,342; 3,099,448; 3,779,550; 3,829,090; 3,970,305; 3,235,258; 3,228,035; 2,794,638; 3,865,383; 3,707,963; 4,400,934; and 2,767,708. However, these devices, either dur to their complexity or lack of adaptability to the natural bending and flexure movements of the human wrist, have not been fully able to provide a support which will restrict the backward flexing of the hand toward the forearm while permitting flexure of the palm of the hand towards the forearm, which movement is desirable in sporting activities such as bowling. Two piece devices have been disclosed in the art, as shown in U.S. Pat. No. 3,970,305, but utilize a single hinge which does not provide for normal wrist movement. In addition, the locking mechanism of that device is compex and cumbersome.

SUMMARY OF THE INVENTION

A first rigid elongated plate has first and second ends, the first end hingedly attached to and adjoining the first end of a rigid link. The second end of the link is hingedly attached to and adjoining an end of a second rigid elongated plate. The hinged attachments permit swinging of the plates towards and away in predetermined included arcs from one side of the link, with the arcs defining and limiting swinging movement through substantially right angles and swinging being limited when the plate and link are substantially coplanar. The end to end dimension of the center link corresponds to the wrist dimension between the hand and forearm to accommodate normal flexing of the hand, wrist, and forearm when the device is attached thereto as hereinafter described.

Each hinged connection between a link end and an adjoining plate end comprises a pair of transversely spaced legs longitudinally extending from one of the adjoining ends of the link and a plate, with the legs being offset normally to the respective surfaces from which they extend. The other of the adjoining ends has a normally offset longitudinally extending tongue which is slidable between the legs, with the tongue and legs contacting the surfaces of the link and the plate to limit hinge movement. Thus, limited hinge movement is provided between the link and each of the plates with a relatively simple construction requiring no hinged pins or hinge loops, is exceptionally durable and has exceptionally strong resistance to hinge movement beyond the predetermined arc limit.

An envelope made of a flexible material encloses and retains the plate and link in end to end hinged attachment. The envelope comprises two layers, one on either side of the plates and link, with one layer placeable against the hand, wrist, and forearm of the user and is preferably cushioned, and with the plates being securely attached, as by a rivet, to the other layer. A transversely extending strap is securely attached to and extends from a side of the envelope at substantially the mid point of the link and is wrappable securely about the user's wrist, with releasable attachment members, such as Velcro attaching fabrics, being at the strap end and on the other layers or outside layer. Additional straps extending from said side of the envelope, with a strap being provided adjacent each of the plates, which straps are snugly and releasably fastened at their ends about the hand and forearm respectively of the user to the outside envelope layer. Thus attached, the apparatus of this invention permits forward flexing of the user's palm towards the forearm but restricts rearward movement of the hand. Due to the use of the center link, the natural curvature of the hand, wrist, and forearm is accommodated not only providing a more natural flexure but also providing greater user comfort. In addition, due to the dual hinge construction, less stress is placed on the envelope during flexure to prolong envelope life. Futher, placement of the support on the user's arm is not as critical.

It has been found that use of the support of this invention provides rigidity needed in supporting and restricting backward movement of the hand during delivery of a bowling ball in its trajectory towards the bowling pins. Such support is particularly desirable since the ball is relatively heavy, usually between twelve and sixteen pounds, and when swung pendulum like from the user's shoulder has considerable inertia. Further, since repeated delivery of the ball is required in the game of bowling, the user's wrist can become considerably fatiqued making ball control more difficult. As mentioned, due to the sturdiness and strength of the hinge construction of this invention, the considerable stress placed on the hinge in the bowling delivery, is readily and adequately supported.

It is therefore an object of this invention to provide a wrist support apparatus which will flex in one direction but resists flexing in another direction and is exceptionally sturdy and durable.

Another object of this invention is to provide in the apparatus of the previous object a three piece hinged mechanism in which in the hinge limit position, the three pieces are substantially coplanar.

A further object of this invention is provide in the devices of the previous objects an envelope for enclosing the rigid pieces and retaining them in adjoining end to end hinged relation.

The above-mentioned and other features and objects of this invention and the manner of attaining them will become more apparent and the invention itself will be best understood by reference to the following description of an embodiment of the invention taken in conjunction with the accompanying drawings.

DESCRIPTION OF THE PREFERRED EMBODIMENT

Figure 1:
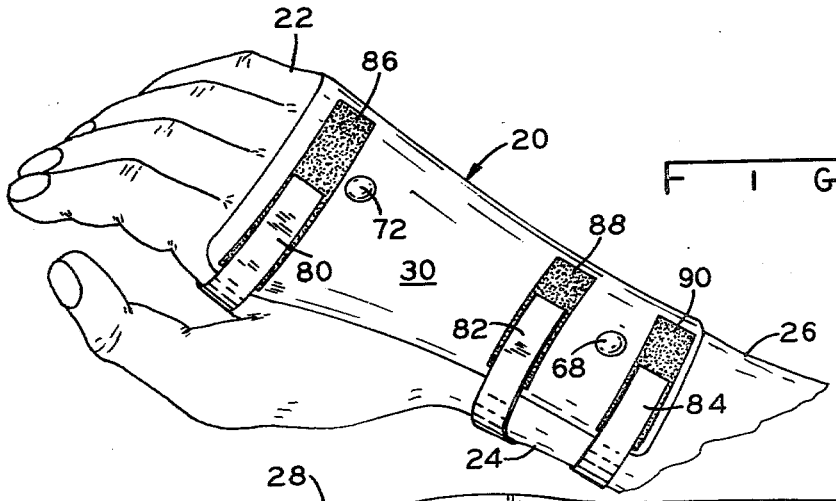
FIG. 1 is a view in perspective of a wrist support of this invention attached to the hand, wrist, and forearm of the user.
Figure 2:
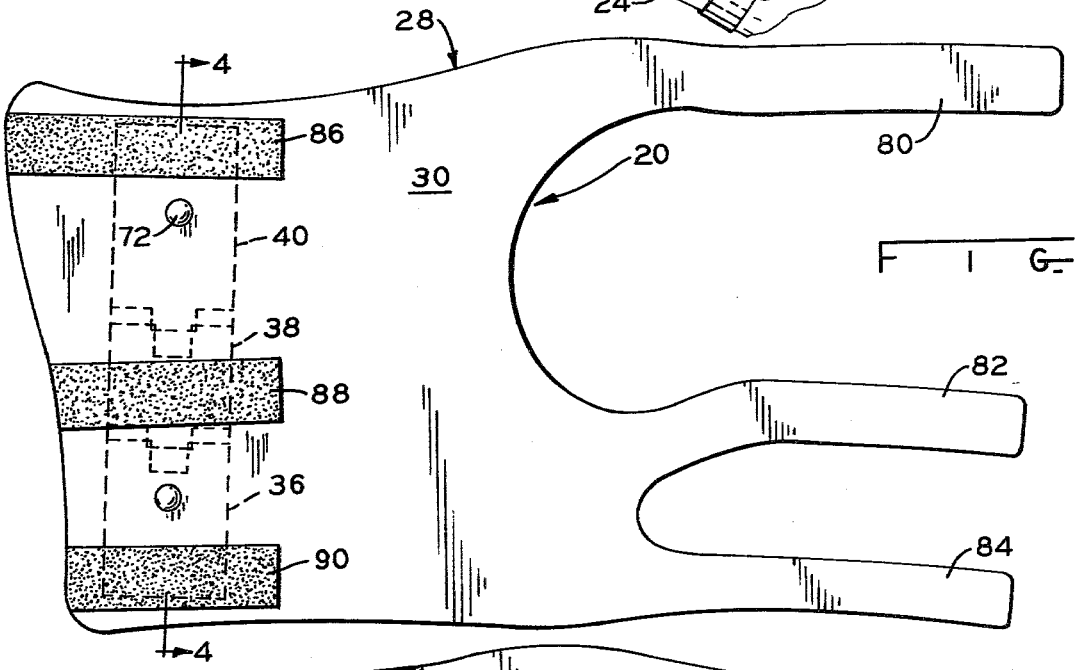
FIG. 2 is a top plan view of the preferred embodiment of FIG. 1 with the plates and center link shown in dashed lines.
Figure 3:
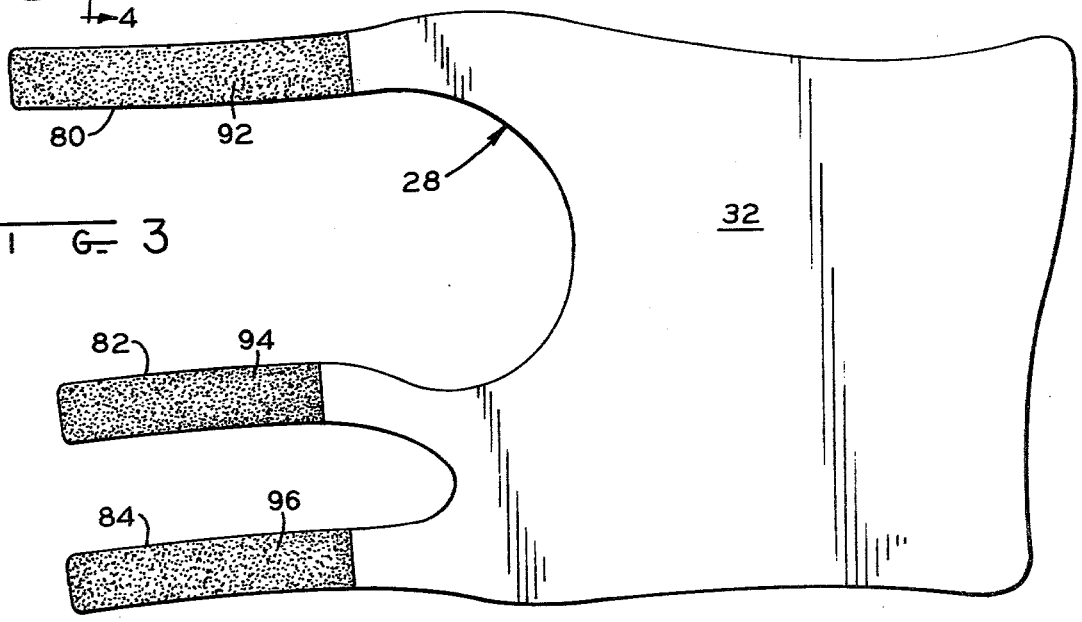
FIG. 3 is a bottom plan view of the preferred embodiment.

Referring to the drawings, FIG. 1, support 20 is shown attached to the user's hand 22, wrist 24, and forearm 26. Support 20 has an envelope 28 with an upper layer 30 of flexible material, such as leather or simulated leather, sewn, or otherwise attached, at its edges to a lower layer 32, which may be a fabric covered layer 33 of foam rubber or other resilient material selected for confort to the wearer or user. Sewn, or otherwise attached in envelope 28, is a first elongated end plate 36, a center link 38 and a second elongated end plate 40. Plate 36 at a first end 42 has a pair of longitudinally extending transversely spaced legs 44, 46 which are normally offset, i.e., vertically raised, from upper surface 48 of plate 36. Center link 38 has at one end 50 a longitudinally extending tongue 52 which is normally offset from upper surface 54 of link 38. The other end 56 of link 38 has a pair of longitudinally extending, transversely spaced legs 58, 60. End 62 of end plate 40 has a longitudinally extending normally offset tongue 64 which is vertically spaced from upper surface 66 of plate 40.

In assembly of the support 20, plate 36 is longitudinally placed against center link 38, with tongue 52 sliding between legs 44, 46 and over upper surface 48 while legs 44, 46 slide over upper surface 54 of link 38. Plate 40 is longitudinally placed against link 38 so that edges 56, 62 are adjoined, with tongue 64 sliding between legs 58, 60 and over surface 54 of link 38, with legs 58, 60 sliding over surface 66 of plate 40. The thus assembled plates 36, 40 and link 38 are then inserted in envelope 28 with rivet 68 fastened through hole 70 in plate 36 and a corresponding hole in layer 30 to securely fasten layer 30 to plate 36. In a similar manner, a rivet 72 is fastened through a hole in cover 30 and hole 74 in plate 40 to securely fasten plate 40 in adjoining end 62 to end 56 relation with link 38. After fastening of rivets 68, 72, lower layer 32 may be attached at its periphery, as by sewing, to layer 30.

Figure 4:
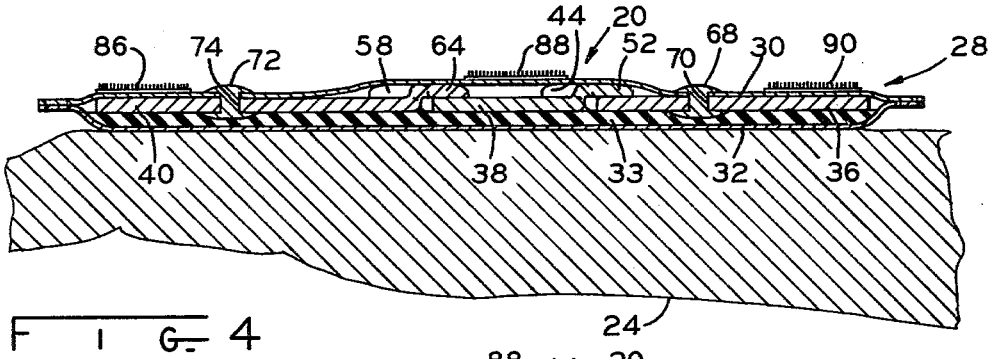
FIG. 4 is a section taken at 4—4 of FIG. 2 with the plates and center link shown in their limited, coplanar hinged position.
Figure 5:
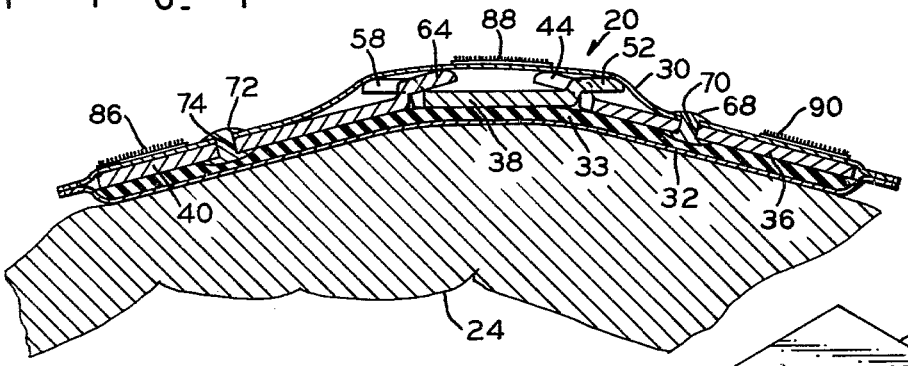
FIG. 5 is a view similar to FIG. 4 wherein the plates and center link are shown in their flexed position.
Figure 6:
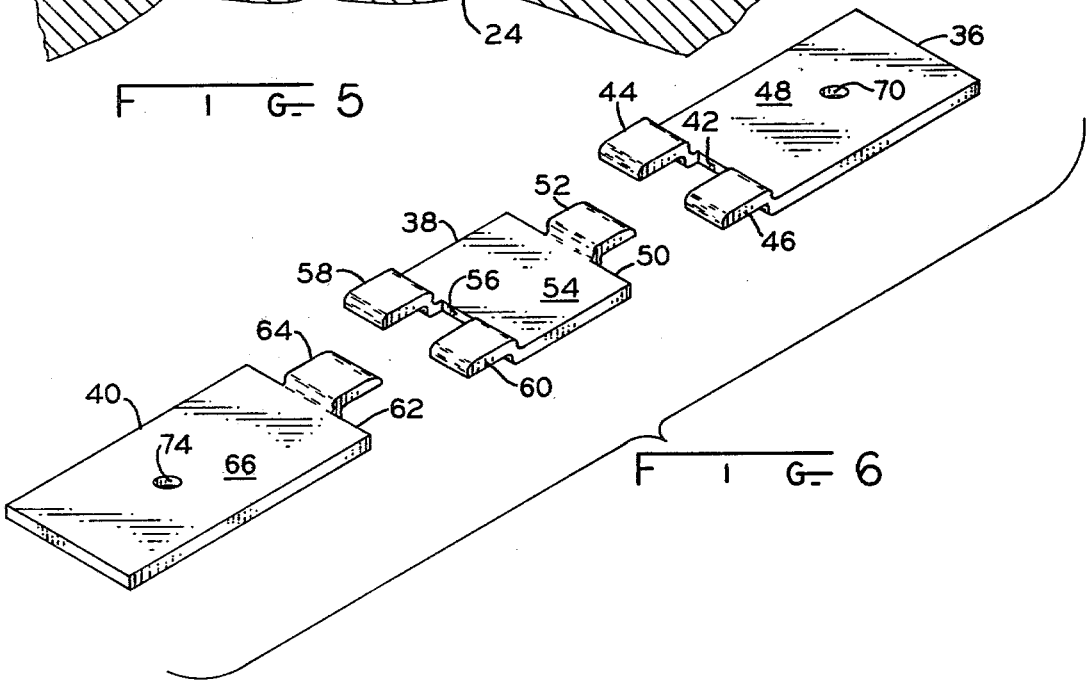
FIG. 6 is an exploded view of the end plates and center link.

The upper outermost corners of legs 44, 46, and legs 58, 60, as well as tongues 52, 64, are preferably rounded to facilitate flexing and minimize wear on the inner surface of layer 30 during the flexed position of the support as shown in FIG. 5. Referring now to FIGS. 4 and 5, the support of this invention is shown in the limit of its hinged movement between plates 36, 40 and link 38. In this position, plates 36, 40, and center link 38 are substantially coplanar and tongue 52 bears against surface 48, and legs 44, 46 bear against surface 54 to resist any upward or counterclockwise hinging of plate 36 relative link 38, the relatively large resistant surface contact providing a very rigid and sturdy hinge stop. Thus, backward bending of the wrist is prevented. As mentioned, this is especially important when the wrist support is used in a sport such as bowling wherein a relatively heavy object is being carried by the hand.

In similar manner, plate 40 is resisted from any upward or clockwise hinging relative length 38 by virtue of tongue 64 abutting surface 54 and legs 58, 60 abutting surface 66. Plates 36, 40, and links 38 may be made of a metal such as aluminum or light alloy. The hinge stop position between plate 36 and link 38 may be varied by varying the angle of legs 44, 46 and/or the angle of tongue 52. For example, if tongue 52 were formed with an angle to surface 54 which was less than 180°, then the hinge stop position between plate 36 and link 38 would be correspondingly changed permitting a further upward pivoting of plate 36 before the stop position was reached. Preferably, the angle of legs 44, 46 to surface 48 would be substantially equal to the angle of tongue 52 to surface 54 for most effective hinge stop action. In the same manner, the hinge stop position between plate 40 and link 38 may be varied.

In flexing of the support, it is seen that plates 36 and 40 are flexed downwardly to accommodate the normal flexing of the user's palm towards his forearm. The curvature formed by the surfaces of plate 40, center link 38, and plate 36, conform to the natural curvature of the user's hand, wrist, and forearm. The length of link 38 between plates 36 and 40 corresponds to the user's wrist dimension between the hand and forearm.

Envelope 28 has transversely extending straps 80, 82, and 84. On layer 30, there are three corresponding strips 86, 88, and 90 of fiber attaching material, such as is sold under the trademark "Velcro", which cooperate with material 92, 94 and 96 on the underside of straps 80, 82, and 84 respectively to result in firm adherence when the two materials are in contact, as shown in FIG. 1 where support 20 is in attached position on the bowler's hand. The strap 80 is positioned at one end of plate 36, and is adapted to wrap under and attach support 20 at the user's hand area; strap 82 is positioned approximately at the mid point of link 38 and is adapted to wrap under and attach support 20 at the user's wrist area, and strap 84 is positioned approximately at the end of plate 40 and is wrapped under and provides attachment of support 20 to the user's forearm. Other fastening materials and devices may be used to provide the snug supported attachment of the support 20 to the user's hand, wrist, and arm. It is important that strap 82 be substantially at the mid point of link 38 for preferred results of this invention. The support is placed on the user to prevent upward movement of the user's hand towards his forearm, as viewed in FIG. 1, but to permit flexing of the user's hand downwardly so that the palm of the hand can be flexed toward the user's forearm.

While there have been described above the principles of this invention in connection with specific apparatus, it is to be clearly understood that this description is made only by way of example and not as a limitation to the scope of the invention.

What is claimed is:

1. Wrist support apparatus comprising:

a first substantially rigid elongated plate having first and second ends;

a substantially rigid link having first and second ends, the first end of said link being in hinged relation to said first end of said first plate to swing toward and away from said first plate within a predetermined included first arc between one side of said plate and one side of said link;

first means for providing a rigid first limit to the swinging action between said first plate and said link to prevent the swinging of said first plate from said one side of said link beyond said first limit, said predetermined arc being defined by said link and said first plate when positioned at said limit;

a second substantially elongated plate having first and second ends, said second end of said second plate being in hinged relation to the second end of said link to swing towards and away from said link within a predetermined included second arc from one side of said second plate and said one side of said link;

second means for providing a rigid second limit between said second plate and said link to prevent the swinging of said second plate from said one side of said link beyond said second limit, said predetermined second arc defined by said link and said second plate when positioned at said second limit;

third means for retaining said first and second plates and link in end to end adjoining hinged relation;

fourth means for releasably holding said plates, link, and third means in supporting relation to the forearm, wrist and hand of the user.

2. The apparatus of claim 1 wherein said included first and second arcs are substantially 180°.

3. The apparatus of claim 2 wherein one side of said first plate overlies the back of the user's hand, one side of said second plate overlies the user's forearm, and said one side of said link overlies the user's wrist and has an end to end distance corresponding to the distance between the user's hand and forearm whereby the user is able to flex the user's hand palm towards the user's forearm but is rigidly limited from flexing the hand in the opposite direction beyond said first limit.

4. The apparatus of claim 2 wherein one of said first ends of said first plate and link has a longitudinally extending tongue; the other of said first ends of said first plate and link has a pair of transversely spaced longitudinally extending legs normally offset from the respective link or plate side reverse to said one side;

said tongue slideable between said legs, and said tongue and legs correspondingly slideable over said respective plate and link reverse side until said first ends are in abutting assembled relation;

one of said second ends of said link and said second plate having a longitudinally extending second tongue; the other of said second ends having a pair of transversely spaced longitudinally extending second legs normally offset from the respective link or second plate side reverse to said one side;

said second tongue slideable between said second legs, and said second tongue and second legs slideable correspondingly over said respective reverse second plate and link sides until said second ends are in abutting assembled relation.

5. The apparatus of claim 4 wherein said envelope has a first layer of flexible material covering said one sides of said plates and link;

a second flexible layer opposite to said first layer covering the reverse sides of said plates and link, said second layer being securely attached to said first and second plates;

said first and second layers being affixed at their edges to one another to securely retain said plates and link in assembled relation.

6. The apparatus of claim 5 wherein said strap members comprise a first strap transversely extending from said envelope at substantially the mid-point of said link; and snugly wrappable and attachable around the user's wrist;

a second strap transversely extending from said envelope from the area of first plate and snuggly wrappable and attachable around the user's hand;

a third strap transversely extending from said envelope from the area of said second plate and snugly wrappable and attachable around the user's forearm.

* * * * *